United States Patent [19]

Dunegan et al.

[11] Patent Number: 4,747,085

[45] Date of Patent: May 24, 1988

[54] METHOD AND APPARATUS FOR MONITORING SWIMMING POOLS

[75] Inventors: Gerald W. Dunegan, 3303 Country Club, Stafford, Tex. 77477; Donald S. Kuhnel, Houston, Tex.

[73] Assignee: Gerald W. Dunegan, Stafford, Tex.

[21] Appl. No.: 832,211

[22] Filed: Feb. 24, 1986

Related U.S. Application Data

[63] Continuation-in-part of Ser. No. 605,896, May 1, 1984, abandoned.

[51] Int. Cl.[4] ..... G08B 21/00

[52] U.S. Cl. ..... 367/93; 340/573

[58] Field of Search ..... 367/93, 131; 340/573

[56] References Cited

U.S. PATENT DOCUMENTS

| | | | |
|---|---|---|---|
| 2,655,645 | 10/1953 | Bagno | 367/93 |
| 2,783,459 | 2/1957 | Lienau et al. | 367/93 |
| 2,832,915 | 4/1958 | McCoy | 340/566 |
| 3,155,954 | 11/1964 | Larrick et al. | 340/566 |
| 3,158,850 | 11/1964 | Poznanski | 340/533 |
| 3,486,166 | 12/1969 | Campana et al. | 367/93 |
| 3,504,145 | 3/1970 | Layher | 340/566 |
| 3,513,463 | 5/1970 | Stevenson, Jr. et al. | 340/541 |
| 3,810,146 | 5/1974 | Lieb | 367/93 |
| 3,867,711 | 2/1975 | Ruscus | 367/131 |
| 4,121,200 | 10/1978 | Colmenero | 340/539 |
| 4,131,887 | 12/1978 | Birkenhead | 340/566 |
| 4,170,769 | 10/1979 | Morris et al. | 340/384 E |
| 4,187,502 | 2/1980 | Beverly et al. | 340/566 |
| 4,260,980 | 4/1981 | Bates | 367/94 |
| 4,290,126 | 9/1981 | McFadyen et al. | 367/93 |
| 4,346,374 | 8/1982 | Groff | 340/573 |

*Primary Examiner*—Glen R. Swann, III

*Attorney, Agent, or Firm*—Norvell & Associates

[57] ABSTRACT

A swimming pool alarm system is provided for actuating an alarm in response to the movement of a person in a swimming pool. The system includes a transmitter mounted below the surface of a swimming pool to continuously transmit ultrasonic sound waves through the body of water, and a similarly positioned receiver detects sound waves in the water and generates an electrical signal in response thereto. The electrical signal is continuously monitored, and the movement of a person in the pool alters the received ultrasonic sound waves and the corresponding electrical signal to produce an alarm signal for actuating an alarm indicator.

15 Claims, 2 Drawing Sheets

METHOD AND APPARATUS FOR MONITORING SWIMMING POOLS

CROSS-REFERENCE TO A RELATED APPLICATION

This application is a continuation-in-part of application Ser. No. 605,896, filed May 1, 1984 now abandoned.

BACKGROUND OF THE INVENTION

The present invention relates to a monitoring system for detecting the movement of an object at least partially disposed in a liquid medium, and more particularly relates to a system for monitoring a swimming pool and providing an alarm indication of the presence of a person, animal, or object entering a swimming pool.

The number of backyard swimming pools has been drastically increasing for the past decade, and such pools obviously present a safety hazard to small children, pets, or adults who are unable to swim. Regardless of the safety precautions normally used by adults, instances will arise when the pool is left unattended by qualified rescue persons. Although various pool alarm systems have been devised, such prior art devices have not been widely accepted by the public for a variety of reasons. Evidence of this fact unfortunately is too frequently supported by drownings of unsupervised small children. In many instances, these children could be rescued if an adult in the house were alerted to the fact that the child had entered the pool.

Most public and private pools are fenced to minimize unauthorized use. Teenagers frequently overcome such protection, however, and the unauthorized usage of pools is quite common. Such unauthorized usage obviously increases the likelihood of vandalism to pool equipment. More importantly, such usage has resulted in teenage injury or deaths due to both the increased risks taken by unattended teenagers, and the increased hazards of swimming at night without adequate lights.

One type of prior art pool alarm system is functionally dependent on the physical movement of water which commonly occurs when a person enters the pool. U.S. Pat. No. 3,468,283, for instance, depends on the relative motion between an outer body and a vane member caused by the movement of water. U.S. Pat. No. 3,504,145 includes a buoyant float which moves relative to an outer container in response to wave action within the pool. Similarly, U.S. Pat. No. 3,732,556 includes a sensor circuit closable by the splash of water thereon. U.S. Pat. No. 4,121,200 discloses a sophiscated system including a transducer responsive to air pressure changes in a tube, which in turn is responsive to water displacement information through a collector. Such devices are highly susceptible to false indications and alarm signals (which defeat the security desired), since the alarm may be easily triggered by wind, blowing leaves, or other surface debris. Moreover, these devices are necessarily unreliable since a small child or pet may slowly enter a pool and cause little wave action.

Another type of pool alarm system is responsive to sound waves which are normally created when a person or animal splashes in a pool. Such systems, as shown in U.S. Pat. No. 2,839,915, typically use a hydrophone to receive the person or animal-generated sound waves, and in response thereto generates an electrical signal to an alarm. Similar systems are disclosed in U.S. Pat. Nos. 3,155,954 (with a sensitivity control); U.S. Pat. No. 3,486,166 (with a selected frequency test circuit); and U.S. Pat. No. 4,187,502 (with an omnidirectional hydrophone). A modified system is illustrated in U.S. Pat. No. 3,867,711, with the apparatus being particularly sensitive to acoustic signals for frequency components in the range of the human heartbeat rate.

This second type of apparatus similarly has not been widely accepted in the industry. In order to achieve the desired sensitivity, such units are costly to manufacture and are preferably installed at several places in the pool. These units are similarly susceptible to false indications such as wind, blowing leaves, or miscellaneous ground noise caused by passing cars. Also, these systems again lack reliability because low frequency acoustical energy produced by a person in the pool cannot be easily distinguished for other miscellaneous background noise.

The disadvantages of the prior art are overcome by the present invention, and improved methods and apparatus are hereinafter provided for reliably detecting the movement of persons, animals, or objects in the pool.

SUMMARY OF THE INVENTION

The present invention employs a piezoelectric transmitting transducer responsive to an oscillator circuit for continuously generating ultrasonic sound waves. The transmitting transducer is placed below the surface of the water and in physical contact with the water, so that the ultrasonic waves permeate the entire body of the water. A piezoelectric receiving transducer is similarly positioned below the surface of the water, and receives ultrasonic sound waves from the water and generates electrical signals in response thereto. This ultrasonic wave-generated electrical signal is amplified and filtered, and this signal may be monitored for any significant changes by a detector circuit. Any movement of persons, animals, or other objects in the water causes the pattern of the electrical signal responsive to the received ultrasonic waves to change, and this change can be used to generate an alarm signal which activates an alarm indicator.

The system of the present invention is not readily susceptible to false alarms caused by wind, blowing leaves, or background noise, since these factors do not significantly affect the received ultrasonic signal. The present invention may be easily provided with an adjustable sensitivity circuit, so that the sensitivity of the device can be easily altered for each particular pool. The device of the present invention may be readily installed in both new pools and existing pools, and may be easily protected to withstand the environment in and surrounding the pool.

These and other features and advantages of the present invention will become apparent from the foregoing detailed description, where reference is made to the figures in the accompanying drawings.

DETAILED DESCRIPTION OF THE PRESENT INVENTION

According to the concept of the present invention, a piezoelectric crystal may be used to transmit ultrasonic waves throughout the body of water in a swimming pool. These ultrasonic sound waves impact a similar receiving transducer which produces corresponding electrical signals. The electrical signals may be amplified, filtered, and monitored to detect movement of a person or animal in the swimming pool.

Figure 1:
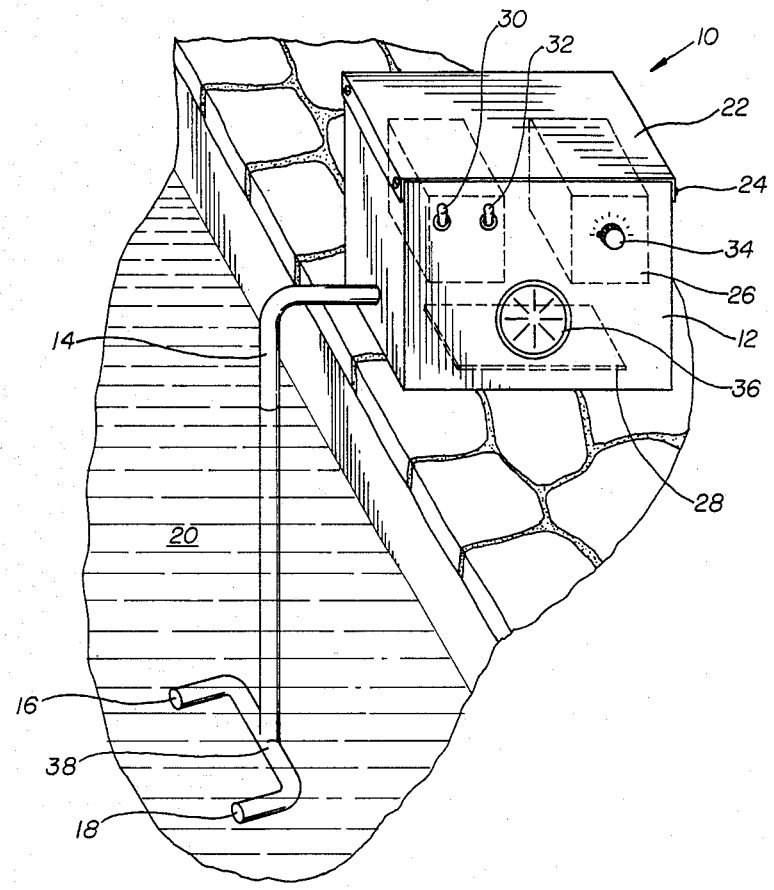
FIG. 1 is a pictorial illustration of a portion of an existing swimming pool provided with an apparatus according to the present invention.

Referring to FIG. 1, it may be seen that a suitable apparatus 10 according to the present invention may be added to an existing swimming pool. An enclosure 12 is provided for housing electrical apparatus, and may be conveniently positioned on the decking by the pool. Plastic conduit 14 extends from the enclosure to a position below the surface of the water 20, and includes standard elbows and tees which may be bonded together by epoxy to form a water-tight enclosure. An electro-acoustical transmitter such as a piezoelectric crystal 16 is provided at an end of a nipple extending from tee 38. A receiving transducer 18 may similarly be positioned at the end of another nipple extending from the other leg of the tee. Each of the crystals may be electrically connected to the enclosure 12 by standard wiring (not shown) passing through the conduit.

The enclosure 12 houses a plurality of 6 volt batteries 26 and an electrical circuit 28 discussed subsequently. An on/off switch 30, manual reset 32, and a sensitivity control 34 extend from the side of the enclosure and are each electrically connected to the circuit 28. Alarm 36 may also be provided in the side of the enclosure, and may be powered by the batteries 26 to generate an audio alarm indicating movement of a person or animal in the water. A removable cover 22 may be secured to the enclosure 12 by screws 24, so that both a water-tight and vapor-tight chamber may be obtained within the conduit 14 and the enclosure 12 to reduce or eliminate corrosion.

Figure 3:
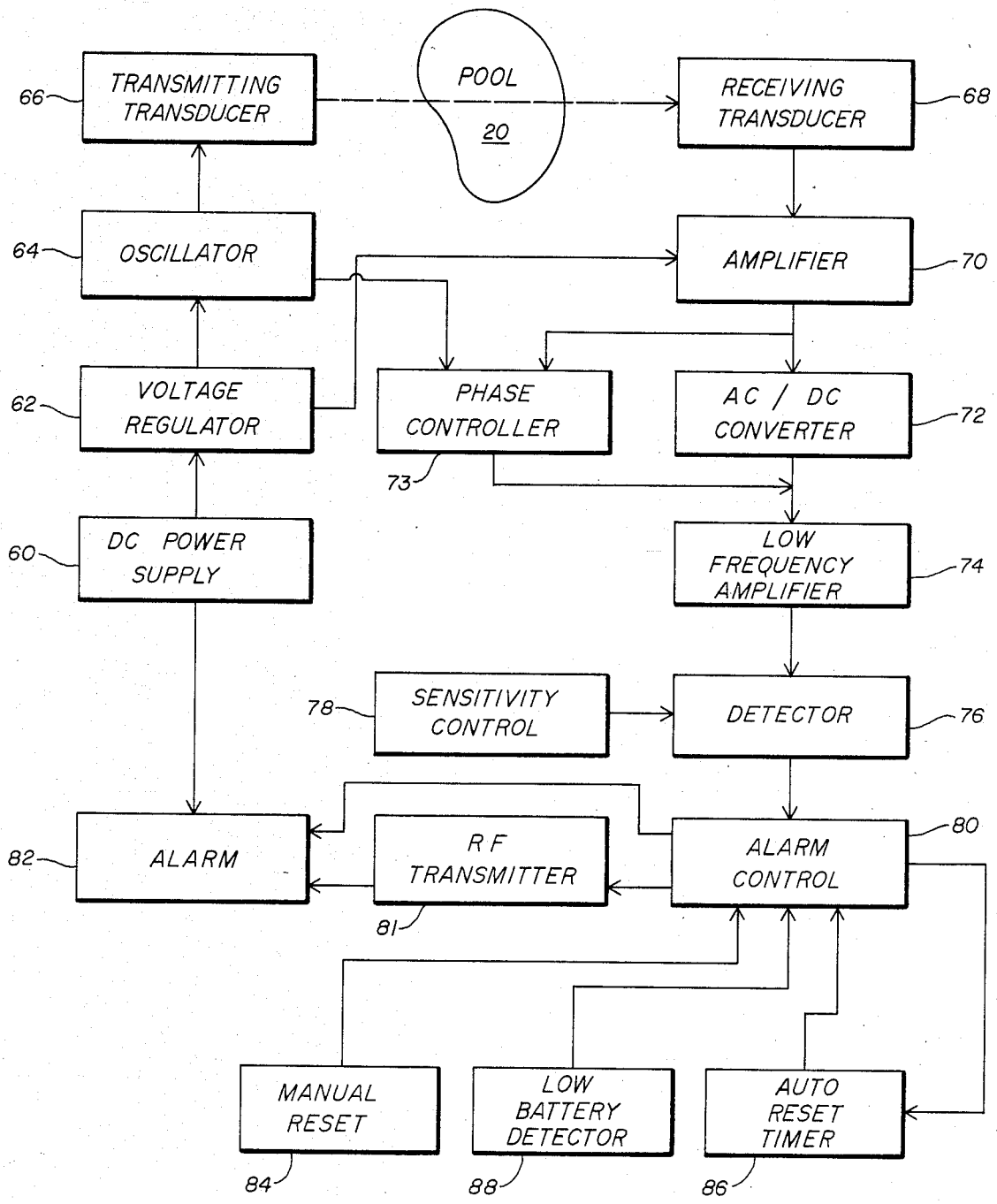
FIG. 3 is a schematic block diagram of the method and apparatus according to the present invention.

Referring now to FIG. 3, a DC power supply 60 may be used to power the transducer 66 (16 in FIG. 1), electrical circuit 28 (comprising the amplifier 70, the AC/DC converter 72, the phase controller 73, the amplifier 74, the detector circuit 76, the alarm control circuit 80, the timer 86, and the detector 88) and the alarm 82 (36 in FIG. 1). Two standard 6 volt series-connected batteries may be employed as the power supply, and the voltage to the oscillator 64 and to the electrical circuit 28 may be regulated within predetermined limits by voltage regulator 62 (shown representatively as being connected only to amplifier 70 of electrical circuit 28) to, e.g., 5 or 6 volts. The Colpitts oscillator 64 generates an oscillating electrical voltage which may be supplied to the transmitting transducer to produce ultrasonic sound waves through the inverse piezoelectric effect. The oscillator 64 requires only a minimal electrical current, e.g., 2 ma, and may be employed with the piezoelectric transmitter 66 to transmit ultrasonic waves of any desired frequency. Typically ultrasonic waves in the range of from 20 KHz to 70 KHz may be used, and preferably in the range of 30 KHz to 50 KHz. A suitable transmitting transducer sold under the tradename MASSA TR 89/B type 40 may be employed.

The transmitted ultrasonic waves travel throughout the body of water in the pool, and are generally reflected by the tile, concrete, fiberglass, or plastic sides and bottom of the pool. Moreover, much of the ultrasonic wave energy incident upon the surface of the pool is reflected back into the pool, and the wave pattern received by the receiving transducer 68 may therefore closely or exactly resemble the wave pattern transmitted by the transmitter 66. In other words, if the 40 KHz wave is produced by the piezoelectric crystal 66, that same frequency wave may permeate the entirety of the pool water, and may be received by a piezoelectric crystal of the same type previously indicated to produce a 40 KHz electrical wave pattern by the direct piezoelectric effect.

The electrical signal produced by this direct piezoelectric effect may be referred to as a fluctuating DC signal, since the DC voltage will vary in accordance with the 40 KHz cycle. For convenience, however, this signal is hereinafter referred to as a biased AC signal or simply an AC signal, since the signal functionally has the behaviour of an alternating current signal. The electrical signal from the receiving transducer 68 may thus be amplified by a standard amplifier circuit 70, and may then be converted into a pure DC signal by converter 72. If no person or animal enters the pool, this signal will remain a steady state DC signal which will not activate the alarm. Also, the peak-to-peak of the AC signal may change depending on various factors, such as the particular pool, the water level in the pool, and the chlorine content of the water. Over a relatively short period of time, e.g., ten seconds, neither the AC signal nor the converted DC signal will appreciably change, however, if no object enters the water within the pool. As previosly indicated, the frequency of the electrical signal from amplifier 70 will match (within selected limits) the known frequency of the ultrasonic waves produced by transmitter 66. A high frequency phase comparator or phase-responsive controller 73 may be used to detect any appreciable shift in the frequency of the signal from the amplifier 70. Thus, the phase comparator 73, which may be provided in parallel with the AC/DC converter 72, may either be used to detect a change in the frequency of the signal from amplifier 70 compared to a fixed or established frequency, e.g. 40 KHz, or may be electronically interconnected with the oscillator 64 to detect a change in frequency from the amplifier 70 compared to the frequency of the sound waves produced by the transmitter 66. The advantage of this latter embodiment is that if the frequency of the ultrasonic waves from the transducer 66 should vary slightly from its intended frequency, the phase controller 73 may detect such slight variations and thus be more truely responsive only to frequency shifts due to the Dopler effect. The signal from the phase-responsive controller 73 may be input directly to the detector 76 to indicate a shift in frequency due to the Dopler effect, or may first be amplified by the circuit 74 since the anticipated phase shift due to the Dopler effect will often be a low-frequency cyclic phase shift.

If a person enters the pool, the AC signal from the receiving transducer 68 may change in several respects. First, movement of the person within the pool water may have a direct effect on the frequency of the ultrasonic waves received by the receiving transducer due to the Dopler effect, which will then have a direct effect on the frequency of the AC signal from amplifier 70. The frequency shift or change between the generated ultrasonic frequency and the received ultrasonic frequency may be in the order of only approximately 10 Hz to 100 Hz, or normally 1 Hz to 25 Hz. A representative 15 Hz frequency shift due to the Dopler effect producing a 39,985 Hz electrical signal from amplifier 70 rather than a 40 KHz signal, may easily be detected by the phase comparator 73 and cause a signal from the detector 76 to activate the alarm. Moreover, this frequency shift will cause an amplitude change due to the "off peak" response of the receiving transducer.

Second, movement of a person in the pool may cause a modulation in the amplitude of the 40 KHz signal received by the transducer 68. This modulation will be due to the presence of a low frequency, e.g., 5 Hz, person-generated wave in addition to (or substracting from) the 40 KHz signal transmitted into the pool. The addition of this low frequency person-generated wave will cause a modulation in the DC signal out of the converter 72, so that the DC signal will modulate in accordance with the added 5 Hz wave rather than remain a constant value DC signal. This additional 5 Hz signal may be received directly by the receiving transducer 68, or may be reflected off the pool walls prior thereto. As indicated in FIG. 3, the low frequency change in the DC signal may be amplified by standard low frequency amplifier circuit 74, and the addition of a low frequency modulation of the DC signal due to the person-generated wave may be detected by the detector 76.

Third, movement of a person or animal in the pool may significantly affect the reflectivity of the water surface to the 40 KHz wave. Surface waves or changes may therefore affect the peak-to-peak value of the AC signal from the receiving transducer 68, so that the DC signal from the converter 72 is no longer stable. As previously indicated, low frequency fluctuations in the DC signal are amplified by 74. The detector 76 may therefore be responsive to changing reflectivity of the water surface caused by movement of a person in the pool.

Movement of a person in the pool is thus detected by the detector 76 due to one or more of the above described changes, and detector 76 thus causes alarm control circuit 80 to activate the alarm 82. The sensitivity of the detector 76 may be easily altered by adjusting sensitivity control 78, which may either be located within the enclosure 12 or may be mounted on the side of the enclosure 12. This sensitivity control 78 may be first adjusted for the particular pool to be monitored and, if necessary, may thereafter be readjusted to obtain the sensitivity desired. If desired, a separate sensitivity control may be provided for the phase controller 73.

A standard low voltage battery detector circuit 88 may be provided, which senses the DC voltage to the voltage regulator and causes alarm circuit 80 to activate the alarm if the DC voltage falls below a preselected value. If desired, a light (not shown) may also be included to indicate that the DC battery should be changed.

A simple manual reset circuit 84 may be electrically connected to toggle switch 32, so that the alarm may be manually shut off and the monitoring circuit reactivated. Also, an automatic reset timer circuit 82 may be provided, so that after the alarm sounds for a prescribed time period, e.g., 10–20 minutes, the alarm will be turned off. Thus, if an object falls in the pool while the pool owner is not home, the alarm will discontinue after twenty minutes if there is no response from the manual reset. If desired, the monitoring circuit may be automatically reactivated after this 10–20 minute period so that the system would detect the subsequent movement of a person in the pool.

Figure 2:
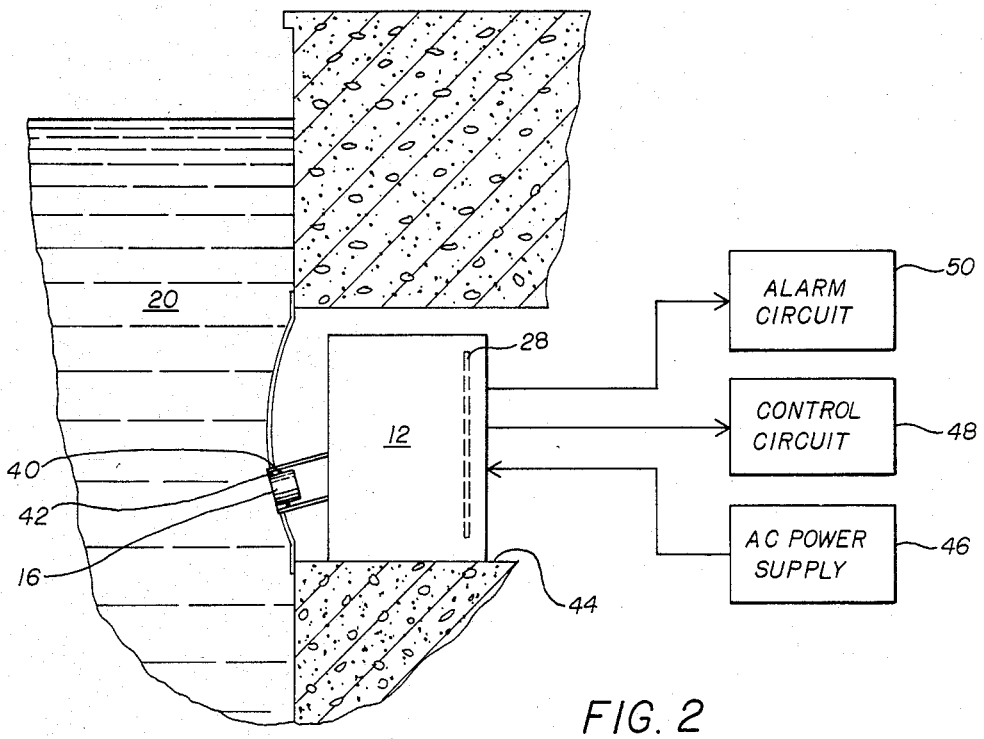
FIG. 2 is a cross-sectional illustration of a portion of a swimming pool originally constructed with apparatus according to the present invention.

Referring now to FIG. 2, it should be apparent that the system according to the present invention may be easily installed in new pools. A water-tight enclosure 44 may be provided in the side of the pool, with two plastic nipples for the piezoelectric crystals extending into the water 20 (only one nipple and crystal being shown in FIG. 2). The piezoelectric crystals 16 and 18 shown in FIG. 1 may be positioned within the plastic conduit by a rubber O-ring 40, which may seal the interior of the conduit from the water. If desired, a silicon-based rubber gel 42 or other suitable sealant may be added to the annulus between the conduit and the piezoelectric crystal to further seal the interior of the conduit from the water. The enclosure 44 shown in FIG. 2 may be functionally similar to the enclosure 12 shown in FIG. 1, and may contain a circuit board 28 and DC batteries as previously described. In this case, it may be desirable to provide a transformer (not depicted) connected to an AC power supply 46 for continuously recharging the batteries. This feature would also insure that the monitoring system of the present invention will remain operationable if there were a temporary loss of AC power. The function of the switches 30, 32, and 34 may now be controlled by a suitable control circuit 48 mounted, for example, on a suitable structure adjacent the pool. As previously indicated, the sensitivity control 34 may be located within the water-tight enclosure 44, since it is envisioned that the sensitivity of the device will only be initially set and not thereafter adjusted or need be infrequently readjusted. Finally, an alarm signal from the circuit 28 may be used to activate any number of conventional alarm indicators, as illustrated in U.S. Pat. Nos. 4,121,200 and 4,187,502, hereby incorporated by reference into the present application. Moreover, this alarm signal may be amplified by the alarm circuit 50, so that the amplified alarm signal may be automatically forwarded to a central emergency unit, such as a police station or fire station.

Low frequency amplifier circuit 74 may filter or exclude DC signals which are not within the desired frequency range. Thus, only fluctuations frequency range of from 0.1 Hz to 100 Hz, and preferably from 0.2 Hz to 25 Hz, will be amplified by the circuit 70. The sensitivity of the phase comparator 73 may be adjusted as necessary to exclude normal frequency fluctuations within selected limits, especially if the comparator 73 is not electronically connected to the oscillator 64. For instance, the transmitting transducer may produce 40 KHz ultrasonic waves plus or minus 2 KHz. Since the ultrasonic signal from the transducer would not appreciably change once installed, however, the comparator 73 may be adjusted to detect only frequencies which varied from the "fired" transducer generated signal by plus or minus 20 Hz. On the other hand, if the comparator 73 is phase-tied to the oscillator 64, the comparator 73 may be used to detect a shift of plus or minus 10 Hz, for example, in the frequency from amplifier 70 compared to oscillator 64. The alarm control circuit 80 of Applicant's invention is preferably responsive to a timing circuit, so that an alarm signal from the detector 76 must be continuously generated for a selected time period greater than 0.2 seconds, and preferably between 0.5 and 1.5 seconds, before the alarm will be activated by the alarm control circuit 80. This feature further reduces the likelihood of a false alarm from the system.

Applicant thus purposefully produces an ultrasonic wave pattern of a known frequency and permeates the pool water with the ultrasonic wave pattern. Changes or modulations in the received wave pattern may be easily and accurately detected, since Applicant produces a known baseline signal for comparison. The signal to noise ratio from the received transducer 68 is thus significantly increased over prior art systems which attempt to detect only the waves generated by the person in the water. Also, the receiving transducer 60 may severely attenuate any received sound waves which are non-ultrasonic or which are not within selected limits, e.g. plus or minus 3 KHz, from the frequency intended to be generated by transducer 66.

Each individual component according to the apparatus of Applicant's invention is readily available. The oscillator circuit 64, amplifier circuit 70, the AC/DC converter 72, the low frequency amplifier 74, the detector 76, and the control switch 80 may be of the type conventionally used in room alarm systems, such as the ultrasonic intrusion alarm system sold under the trade name Heathkit GD-49. The voltage regulator 62, the phase controller 73, the sensitivity control 78, and the low battery detector 88 are each standard components in various electronic devices. Alternate embodiments of a low frequency amplifier circuit, a detector circuit, and an alarm control circuit are shown in U.S. Pat. No. 3,513,463, and further variations on a suitable alarm control circuit are shown in U.S. Pat. Nos. 4,170,769 and 3,158,850. Accordingly, each of the above three references are hereby incorporated by reference into the present application.

Another variation on the present invention may be made by combining the functions of the AC/DC converter 72 and the phase comparator 73. The efficiency of the capacitators in the AC/DC converter may be frequency dependent, so that variations in the frequency of the electronic signal to the AC/DC converter would produce modulations in the DC output signals sufficient after amplification to be detected by the detector 76.

As previously stated, various conventional alarm indicators may be activated by the alarm control 80, such as lights, horns, etc. It is a further feature of the present invention that the signal from the alarm control 80 be utilized to activate a transmitter 81, which generates an RF signal to a remote alarm indicator 82. Thus, the signal from the transmitter 81, which may conveniently be located by the side of the pool, may be used to activate either an RF responsive alarm located in a nearby house or a car, or an RF responsive "buzzer" alarm carried by one or more adult persons.

Although the mounting of the transducers 66 and 68 is not critical to the operability of the present invention, it has been found desirable to place the transducers six inches or more below the surface of the water and inclined downward at an angle of between 5° and 30°. Also, the transmitting transducer and receiving transducer may be placed at any desired location along the edge of the pool, and the transducers may conveniently be located adjacent one another without adversely affecting the sensitivity of the unit to the movement of a person in the water.

It is also within the concept of the present invention to transmit throughout the body of water in a pool and receive subsonic sound waves below 15 Hz. The transmission and reception of such low frequency sound waves is practical because of the high transmissability of the fluid medium. A primary feature of such a system would be that known frequency sound waves would be generated and influenced by movement of a person in the water due to the Dopler effect, the combination of person-generated and transmitter-generated waves, and the variance in the reflectivity of the disturbed water surface from the still water surface for the generated signals. The modified subsonic type of unit would also benefit from the increased signal to noise ratio compared to a system which simply detected person-generated waves.

It is apparent that the present invention is one well adapted to obtain all the advantages hereinabove set forth, together with other advantages which will become obvious and inherent from the description of the apparatus and methods themselves. It will be understood that certain combinations and subcombinations are of utility and may be obtained without reference to other features and combinations. This is contemplated by and is within the scope of the present invention.

What is claimed is:

1. Apparatus for monitoring unauthorized or unintentional entry of a person or animal into a swimming pool, comprising:

an oscillator circuit for continuously generating an oscillating electrical voltage of a preselected frequency;

an electro-acoustical transmitting transducer means positioned below the surface of the water in said swimming pool and in contact with the water for permeating ultrasonic sound waves throughout said water in said pool in response to said oscillator circuit, said transmitting transducer means being mounted at a downwardly projecting angle of between 5° and 30°;

transducer means positioned below said surface of said water and in contact with the water for receiving said ultrasonic sound waves from throughout said water and generating an electrical signal in response to said ultrasonic sound waves;

amplifying means for increasing the strength of a portion of said electrical signal having a frequency in the range of from 0.2 Hz to 25 Hz;

water-resistant housing means for sealing at least portions of said electro-acoustical transmitter and said receiving transducer from said water;

a detector circuit for monitoring said amplified portion of said electrical signal and generating an alarm signal in response to a change in said amplified portion of said electrical signal; and an alarm indicator responsive to said alarm signal.

2. The apparatus as defined in claim 1, wherein said electro-acoustical transmitting transducer produces ultrasonic sound waves in the range of from 30 KHz to 50 KHz.

3. The apparatus of claim 2, wherein said amplifying means comprises:

a converter for generating a second electrical signal having a frequency substantially below 30 KHz in response to said first-recited electrical signal; and a low frequency amplifier for amplifying fluctuations in said second electrical signal in the range of 0.2 Hz to 25 Hz.

4. The apparatus as defined in claim 1, wherein said electro-acoustical transmitting transducer is a piezo-electrical crystal.

5. The apparatus as defined in claim 1, further comprising:

a battery source for powering said oscillator circuit; and a voltage regulator for regulating voltage to said oscillator circuit from said battery source.

6. The apparatus as defined in claim 1, wherein said receiving transducer is a piezoelectric crystal.

7. The apparatus as defined in claim 6, wherein said receiving piezoelectric crystal is mounted closely adjacent said electro-acoustical transmitting transducer.

8. The apparatus as defined in claim 1, wherein the detector circuit comprises:

a detector for generating said alarm signal when said amplified flucations exceed selected limits.

9. A method for monitoring entry by a person or animal into a swimming pool, comprising:

placing a transmitting piezoelectrical crystal below the surface of said water and directed at a downwardly projecting angle of between 5° to 30° nad in physical contact with said water;

supplying an oscillating electrical voltage to said piezoelectric crystal for producing ultrasonic sound waves;

placing a receiving piezoelectric crystal below the surface of said water and in physical contact with said water for receiving said ultrasonic sound waves and generating an electrical signal in response thereto; and continuously monitoring said electrical signal and generating an alarm signal in response to a change in said electrical signal.

10. The method as defined in claim 9, wherein said oscillating electrical voltage supplied to said transmitting piezoelectric crystal is controlled within preselected limits.

11. The method as defined in claim 9, wherein said ultrasonic sound waves are generated at a frequency of between 20 KHz and 50 KHz.

12. The method as defined in claim 9, further comprising:

activating an alarm in response to said alarm signal.

13. A method as defined in claim 9, further comprising:

amplifying fluctuations in said electrical signal generated in response to said received ultrasonic sound waves in the range of from 1 Hz to 25 Hz.

14. The method as defined in claim 9, wherein said alarm signal is generated in response to a change in said electrical signal having a duration of at least 0.2 seconds.

15. The method as defined in claim 9, wherein monitoring said electrical signal comprises:

detecting a portion of said electrical signal having a frequency at between 1 Hz and 25 Hz for generating said alarm signal.

* * * * *